US005597095A

United States Patent [19]

Ferrara, Jr.

[11] Patent Number: 5,597,095

[45] Date of Patent: Jan. 28, 1997

[54] DUAL ARM AEROSOL ACTUATOR HAVING A MOVABLE AND STATIONARY ARM

[75] Inventor: Daniel A. Ferrara, Jr., Bantam, Conn.

[73] Assignee: Precision Valve Corporation, Yonkers, N.Y.

[21] Appl. No.: 71,769

[22] Filed: Jun. 9, 1993

[51] Int. Cl.[6] ..... B65D 83/00

[52] U.S. Cl. ..... 222/402.12; 222/402.13; 222/402.15

[58] Field of Search ..... 222/321.8, 402.12, 222/402.13, 494, 507, 537, 402.15; 239/579

[56] References Cited

U.S. PATENT DOCUMENTS

| | | | |
|---|---|---|---|
| 729,423 | 5/1903 | Scheiber et al. . | |
| 1,969,960 | 8/1934 | Blum . | |
| 2,303,130 | 11/1942 | Moon . | |
| 2,378,451 | 6/1945 | Vensel . | |
| 2,400,231 | 5/1946 | Gebauer et al. . | |
| 2,605,021 | 7/1952 | Churchill et al. . | |
| 2,632,585 | 3/1953 | Tomasek . | |
| 2,702,957 | 3/1955 | Cooprider et al. . | |
| 2,820,578 | 1/1958 | Dickman . | |
| 2,822,054 | 2/1958 | Howard . | |
| 2,822,961 | 2/1958 | Seaquist . | |
| 2,877,934 | 3/1959 | Wallace . | |
| 2,908,334 | 10/1959 | Duggan . | |
| 3,085,720 | 4/1963 | Boch et al. . | |
| 3,100,065 | 8/1963 | Gross . | |
| 3,104,061 | 9/1963 | Boch et al. . | |
| 3,138,331 | 6/1964 | Kutik . | |
| 3,159,319 | 12/1964 | Parish . | |
| 3,161,331 | 12/1964 | Murtha | 222/402.12 |
| 3,162,332 | 12/1964 | Hayim . | |
| 3,211,384 | 10/1965 | Seaquist . | |
| 3,254,807 | 6/1986 | Boch et al. . | |
| 3,323,686 | 6/1967 | Roth . | |
| 3,539,151 | 11/1970 | Reid et al. . | |
| 3,584,789 | 6/1971 | Traynor . | |
| 3,588,040 | 6/1971 | Ward . | |
| 3,595,445 | 7/1971 | Buford et al. . | |
| 3,625,403 | 12/1971 | Rousselot . | |
| 3,704,811 | 12/1972 | Harden, Jr. . | |
| 3,788,526 | 1/1974 | Thornton et al. . | |
| 4,061,250 | 12/1977 | Tada . | |
| 4,186,855 | 2/1980 | Edman et al. . | |
| 4,345,702 | 8/1982 | Wolfe . | |
| 4,530,448 | 7/1985 | Ponyicky . | |
| 4,671,436 | 6/1987 | Hagan . | |
| 4,684,037 | 8/1987 | Gnutti et al. . | |
| 4,742,963 | 5/1988 | Marvaldi . | |
| 4,756,347 | 7/1988 | Hagan et al. . | |
| 4,773,571 | 9/1988 | Hagan et al. . | |
| 4,782,982 | 11/1988 | Ellison . | |
| 4,850,387 | 7/1989 | Bassill . | |
| 5,014,963 | 5/1991 | Nakayama et al. . | |
| 5,018,647 | 5/1991 | Abplanalf | 222/402.15 X |
| 5,118,080 | 6/1992 | Hartmann . | |
| 5,154,328 | 10/1992 | Gueret | 222/494 |

*Primary Examiner*—Gregory L. Huson
*Attorney, Agent, or Firm*—Kilgannon & Steidl

[57] ABSTRACT

A pinch operated dispensing actuator for dispensing materials from a container is disclosed with a first arm for engagement by one's thumb and a second arm for supporting one's index finger. The first arm is part of a lever arm which rotates about a hinge under pressure to provide a mechanical advantage easing actuation of the outlet means of the container. The container is actuated by pinching one's thumb and index finger together. The discharge duct of the dispensing actuator can be part of the first or second arm, which enables dispensing of material in the same direction as the person actuating the container, preferably into the same hand that actuates the container. The discharge duct can also be located at other portions of the dispensing actuator, for all types of dispensing, including dispensing of product into one's free hand, onto objects such as a toothbrush, onto surfaces or into the air.

8 Claims, 11 Drawing Sheets

DUAL ARM AEROSOL ACTUATOR HAVING A MOVABLE AND STATIONARY ARM

FIELD OF THE INVENTION

A dispensing actuator for dispensing materials from a container and, more particularly, a dispensing actuator cap with improved mechanical leverage for opening a valve or other such outlet means of a container. The dispensing actuator provides a lever portion, preferably for engagement by a user's thumb, and a supporting arm, preferably for engagement by the index finger of the same hand. The arms and discharge duct of the actuator can be positioned to align a user's hand such that the material will be dispensed into the proper location in the same hand which actuates the cap, enabling the user to dispense material without lifting the container. The dispensing actuator can be used for traditional dispensing of material in a direction away from the user, as well.

BACKGROUND OF THE INVENTION

Traditionally, containers for discharging cosmetic products, such as shaving cream or soap, require two hands for use. One hand holds, positions and actuates the container so that material is dispensed into the proper location in the other hand. It is often desirable, however, to dispense products with one hand, directly into the same hand. This leaves the second hand free, if desired or necessary. It is also often desirable to dispense products while the container is standing in position on a sink or counter, without lifting the container. Such one-hand actuation can be easier and neater in dispensing shaving cream, soap, cosmetics, tanning lotion, toothpaste, and many other products. The ability to dispense certain products with only one hand, freeing the second hand, could be particularly useful in a hospital emergency room, operating rooms or in other medical applications.

Traditional dispensing also usually requires that an extended index finger depress the actuator of the dispensing mechanism. This is an awkward, ergonomically inefficient action. The fingers and hand can provide much greater leverage when in a closed or semi-closed position. The thumb is a particularly strong digit which can provide greater leverage for actuation than the index finger. The ergonomically inefficient configurations of traditional dispensing mechanisms can cause finger fatigue or may be incapable of actuation by the weak, elderly or infirm.

In addition, most traditional aerosol and pump dispensers provide an actuator directly above the actuator valve of the container. This provides little or no mechanical advantage on actuation. It would be advantageous to provide a lever arm which engages the container valve and has a portion for engagement by a user's finger. The container valve can then be actuated by rotation of the lever. As long as the distance from the point of engagement by the user's finger on the lever arm to the hinge of the lever arm is greater than the distance from the valve stem (or other part of the container to be actuated) to the hinge of the lever arm, a mechanical advantage is provided, easing actuation. The greater the difference between these two lever arms, the greater the mechanical advantage.

SUMMARY OF THE INVENTION

A dispensing actuator is disclosed for dispensing material stored within a container having an outlet means through a "pinching" type action preferably involving a user's thumb and index finger. The dispensing actuator comprises a means for engaging the outlet means of the container, a discharge duct for allowing product to exit the dispensing actuator, and a product passage means for conveying material from the outlet means of the container to the discharge duct of the dispensing actuator. Two proximate arms extend from the dispensing actuator in the same direction, one arm being moveable towards the other arm and being associated with the outlet means of the container such that by moving the moveable arm towards the other arm, the outlet means is actuated to dispense material. Preferably, the moveable arm has a terminus portion for engagement by a user's digit and the distance from the axis to the terminus portion is greater than the distance from the axis to the means for engaging the outlet means. The discharge duct can be located in the moveable arm or the other arm, for dispensing of material towards the user, such as into the user's hand. The discharge duct can also be located in another portion of the cap for dispensing of material away from the user, such as onto a surface, into the air, into the user's second hand or onto a spoon or toothbrush held in the user's second hand. Such a dispensing actuator can be used to dispense a wide variety of material, including shaving cream, soap, cosmetics, tanning lotion, toothpaste, medical products or air fresheners. The dispensing actuator of the present invention is easier to actuate in a controlled manner than traditional actuators.

A dispensing actuator cap for dispensing material stored within a pressurized container having a valve with a valve stem is also disclosed. The cap comprises a lever portion capable of rotating about an axis when sufficient pressure is exerted upon it. The lever portion has a terminus portion extending from the cap, for engagement by a user's thumb. A supporting arm extends from the cap in the same direction as the terminus portion of the lever portion for providing support for a user's index finger. The supporting arm is positioned proximate and below the lever portion. A product conveying duct is also provided having a first and second end. The first end of the duct is adapted to receive the valve stem. The second end is a discharge duct portion for allowing the discharge of material out of the cap. The lever portion is associated with the product conveying duct. Pressure exerted by the user's thumb causes sufficient rotation of the lever portion to displace the product conveying duct, actuating the valve of the container, causing the dispensing of material through the product discharge duct, out the discharge duct portion. The discharge duct portion can be associated with the terminus portion of the lever arm, the supporting arm, or some other portion of the cap. Preferably, the distance from the axis of rotation of the lever portion to the terminus portion of the lever portion is greater than the distance from the axis of rotation of the lever portion to the valve stem.

In another embodiment, a dispensing actuator cap for dispensing material stored within a pressurized container having a valve with a valve stem for dispensing into the same hand which operates the cap is also disclosed. The cap comprises a lever portion capable of rotating about an axis when sufficient pressure is exerted upon it. The lever portion has a terminus portion extending from the cap and an upper surface for engagement by a user's thumb. A supporting arm extends from the cap in the same direction as the terminus portion of the lever portion, positioned proximate and below the lever portion. The supporting arm is essentially stationary and has a lower surface for engagement by a user's index finger. When the user's thumb engages the lever arm and the user's index finger engages the supporting arm, the user's hand is positioned to receive dispensed material. A product conveying duct has a first and second end, the first end being adapted to receive the valve stem and the second end being a discharge duct portion for allowing the discharge of material out of the cap. The lever portion is associated with the product conveying duct. The distance from the axis to the terminus portion is greater than the distance from the axis to the valve stem. Pressure exerted by the user's thumb causes sufficient rotation of the lever portion to displace the product conveying duct, actuating the valve of the container, causing the dispensing of material through the product discharge duct, out the discharge duct portion, into the user's hand. The discharge duct portion can be in the terminus portion of the lever portion or the supporting arm. This embodiment is particularly suited for dispensing materials such as shaving cream, soap, or certain medical products, where single handed use is advantageous.

The above embodiment can be modified to dispense material in a direction away from the user by changing the position of the discharge duct portion. Such an embodiment is particularly useful for dispensing air fresheners and household treatments such as window cleaners, disinfectants, insecticides, spray paint, and the like, as well as shaving cream, soap or other such materials.

In another embodiment, a dispensing actuator cap is disclosed for dispensing material stored within a container having an outlet means. The cap comprises a lever arm, a means for engaging the outlet means of the container, a discharge duct integral with the lever arm for allowing product to exit the dispensing actuator, and a product passage means for conveying material from the outlet means of the container to the discharge duct of the dispensing actuator. The lever arm is associated with the outlet means of the container such that sufficient rotation of the lever arm actuates the outlet means, causing dispensing of material.

Any of the embodiments described can include a product shutoff valve, preferably a self-closing valve, in the discharge duct to prevent the drying of material left within the product conveying duct between uses.

A method of actuating a container with a dispensing actuator having a first and second arm, the container having an outlet means, is also disclosed. The method comprises engaging a first arm of the actuator cap with a thumb, the first arm being associated with a means for actuating the outlet means of the container; engaging a second arm of the actuator cap with a finger of the same hand as the thumb; and moving the first arm toward the second arm sufficiently to actuate the outlet means of the container.

DESCRIPTION OF THE INVENTION

THE FIRST EMBODIMENT

Figure 1:
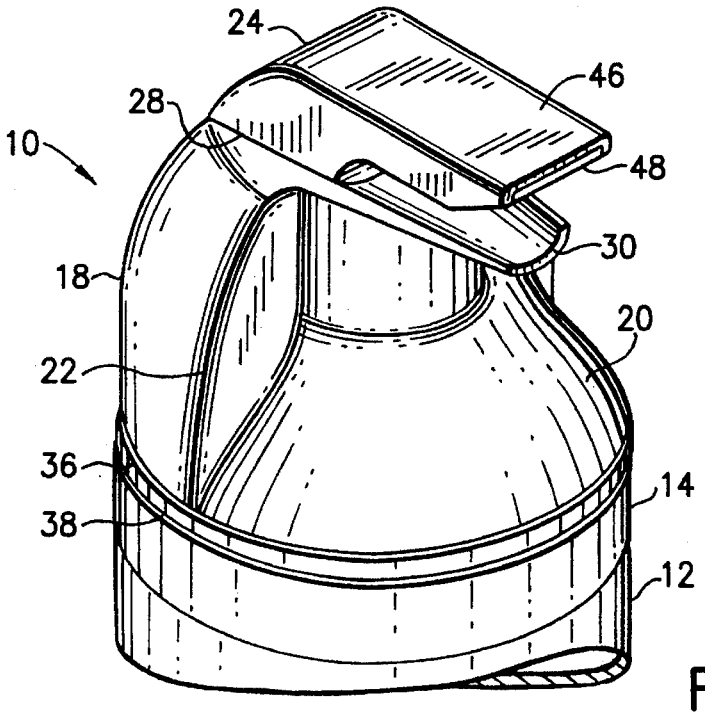
FIG. 1 is a perspective view of a dispensing actuator cap of the first embodiment of the present invention positioned on a container.
Figure 2:
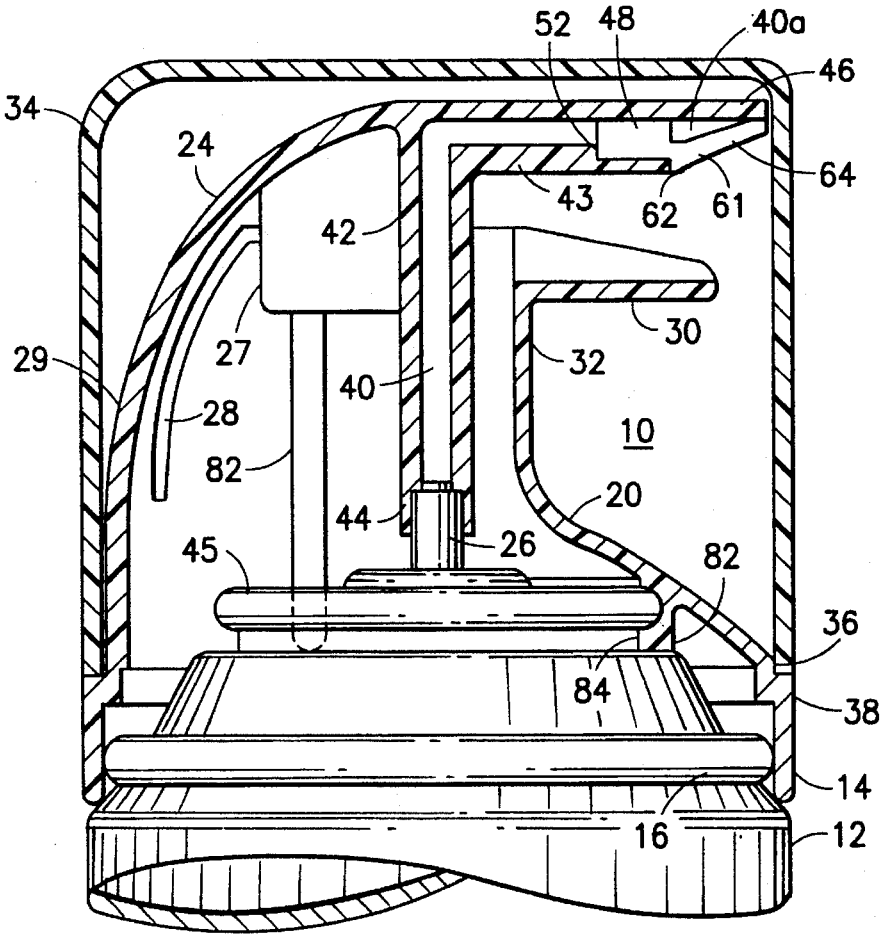
FIG. 2 is a cross-sectional view of the dispensing actuator cap of FIG. 1 positioned on the container, with an overcap.

FIG. 1 is a perspective view of a first embodiment of a dispensing actuator 10 of the present invention in position on a container 12 (shown in part). The dispensing actuator can be a cap which snaps onto the container, as shown in FIGS. 1–2, or the dispensing actuator can be formed integral with the container. The container 12 is a pressurized container with a valve stem 26 (shown in FIG. 2) and a valve (not shown) extending from a mounting cup 45, as is known in the art. The valve is preferably actuated by vertical displacement of the valve stem 26, but a tilt actuated valve can also be used. The dispensing actuator of the present invention can be used with other types of containers with other types of outlet means, as is discussed further below.

FIG. 2 is a partial, cross-sectional view of the cap 10 of FIG. 1 attached to the container 12. As shown in FIGS. 1 and 2, the cap 10 comprises a generally circular closed base portion 14 which generally encircles the outer container bead 16 of the container 12. In the embodiment of the invention shown in FIGS. 1–5, a rear, generally semicircular wall portion 18 and a forward wall portion 20 extend from the base portion 14. The walls 18 and 20 are preferably recessed from the circumference of the base portion 14 to provide space to accommodate an overcap 34, shown in cross-section in FIG. 2. A shoulder 36 is provided at the top of the base portion 14 for engaging and securing the overcap 34, which snaps onto the shoulder portion 36, as is known in the art. The overcap 34 rests on a circumferential ledge portion 38 of the base 14. The rear and forward wall portions 18, 20, respectively, meet at line 22, shown in FIG. 1.

A first arm is part of a lever portion 24, which extends from the rear wall 18, over the top and towards the front of the cap 10. The lever portion 24 is preferably defined by a slot 28 in the rear wall 18, which preferably has a parallel portion 28*a* and a connecting portion 28*b*, best shown in the top and bottom views of FIGS. 3 and 5, respectively. A supporting rib 27 is preferably provided in the interior of the cap 10 to partially define the slot 28. The rib 27 provides support to the lever arm 24. See also FIG. 5. The parallel slot portion 28*a* defines a hinge region, generally designated as 29, about which the lever portion 24 rotates. The lever portion 24 can be rotated downward, preferably by a user's thumb, to actuate the container valve through displacement of the valve stem 26, shown in FIG. 2. Dispensing of material is discussed further, below. The hinge region 29 is preferably in about the same horizontal plane as the top of the valve stem 26, as shown in FIG. 2. This minimizes the distance the lever arm 24 must be depressed to actuate the valve of the container.

Figure 3:
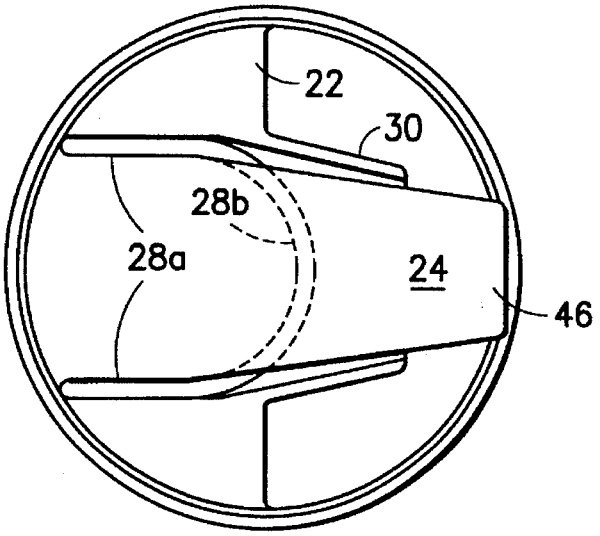
FIG. 3 is a top view of the dispensing actuator cap of FIG. 1.
Figure 4:
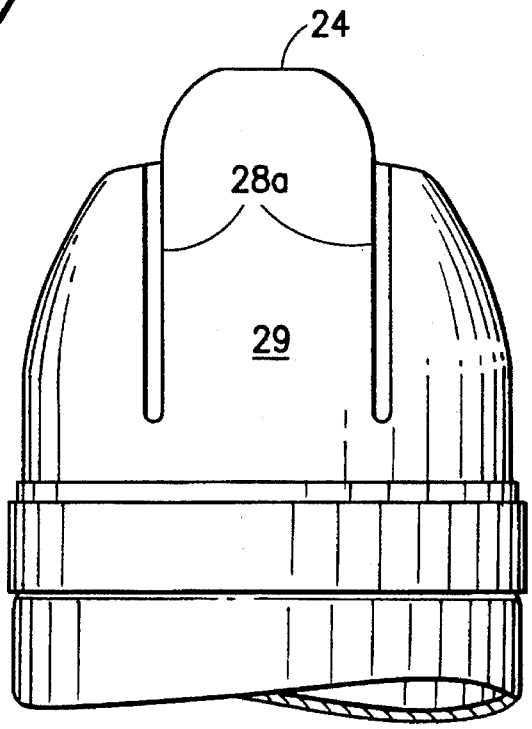
FIG. 4 is a rear view of the dispensing actuator cap of FIG. 1.

FIG. 3 is a top view of the dispensing actuator cap 10 of FIG. 1, showing the parallel portion 28*a* and the connecting portion 28*b* in phantom. The remainder of the connecting portion 28*b* is obstructed in the view of FIG. 3 by the lever portion 24. FIG. 4 is a rear view of the cap 10, showing the parallel portion 28*a*, the hinge portion 29 and the rear of the lever arm 24.

Figure 13:
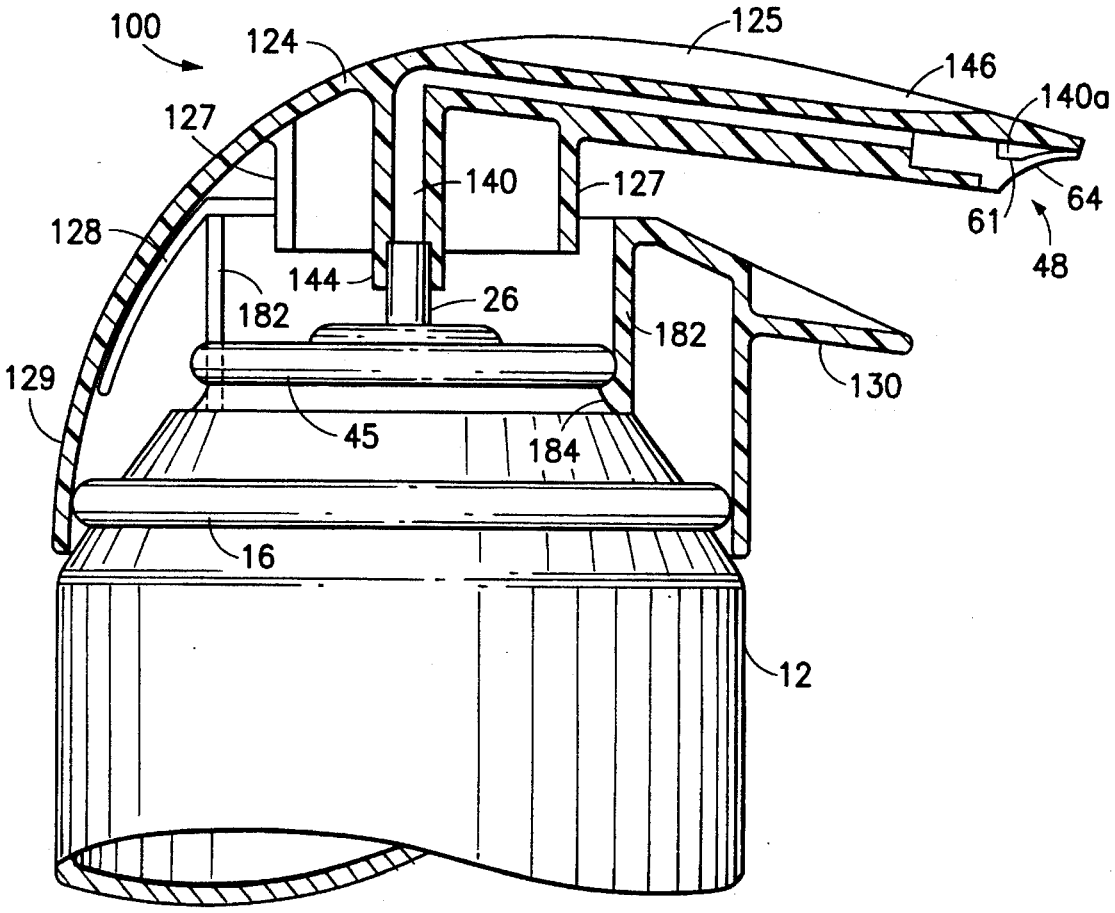
FIG. 13 is a cross-sectional view of the dispensing actuator cap of FIG. 12.

A second, supporting arm 30 extends from an upper portion 32 of the forward wall 20, beneath and in the same direction as the lever arm 24, as shown in FIGS. 1–2. The supporting arm 30 provides a support for a user's finger, preferably the index finger, during actuation, and properly positions one's hand to receive dispensed product, as shown in FIG. 13 and described further, below. The supporting arm is preferably essentially stationary. It is also preferably wider than the lever arm 24, as shown in FIG. 3.

A product conveying duct 40 has an essentially vertical tube portion 42 and an essentially horizontal tube portion 43. In this embodiment, the horizontal tube portion 43 is integral with the lever portion 24 while the vertical tube portion 42 depends from the lever portion 24. The bottom portion 44 of the vertical tube portion 42 is adapted to engage the valve stem 26 of the container 12, as shown in FIG. 2. The discharge duct portion 40*a* of the product conveying duct 40 coincides with the terminus portion 46 of the lever portion 24.

If the material to be dispensed can linger in the product conveying passage 40 between uses, it can dry. Such dry material can clog the passage 40 or be dispensed on subsequent use, annoying the consumer. Therefore, when used with viscous, semi-solid or other such material, such as shaving cream, soap, or toothpaste, the discharge duct portion 40*a* is preferably adapted to receive a product shutoff valve, such as the self-closing valve 48. The valve 48 seals the discharge duct portion 40*a* when material is not being dispensed, preventing material left in the duct 40 from drying between uses. The valve 48 also aids in keeping the product conveying duct 40 and discharge duct portion 40*a* free of contamination. The valve opens under the pressure of discharging product during actuation, as described, below. FIGS. 7–10 illustrate various views of the valve 48. The valve is discussed in U.S. Ser. No. 08/011,342, filed on Jan. 26, 1993, and assigned to the assignee of the present invention.

Figure 6:
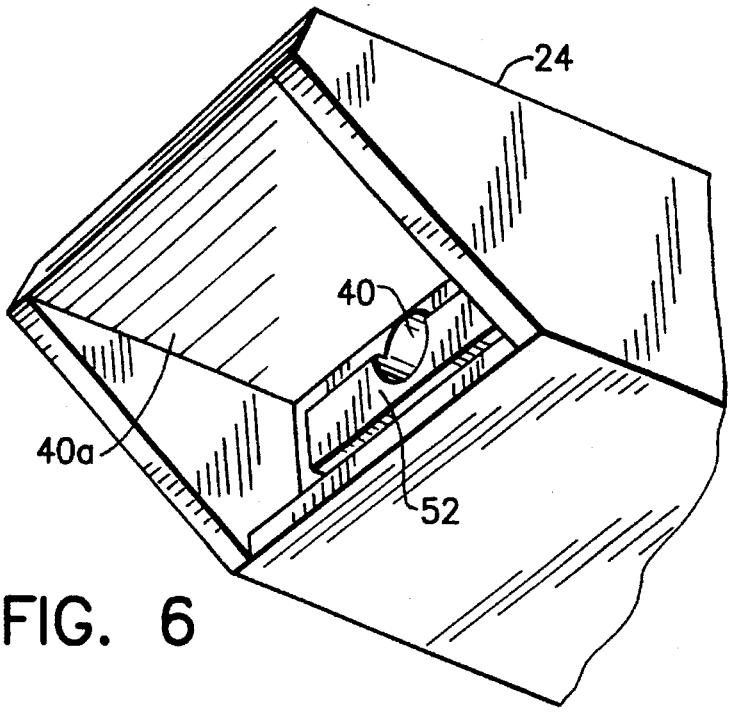
FIG. 6 is a lower perspective view of the terminus portion of the lever portion of the dispensing actuator cap of FIG. 1, with the valve removed.
Figure 7:
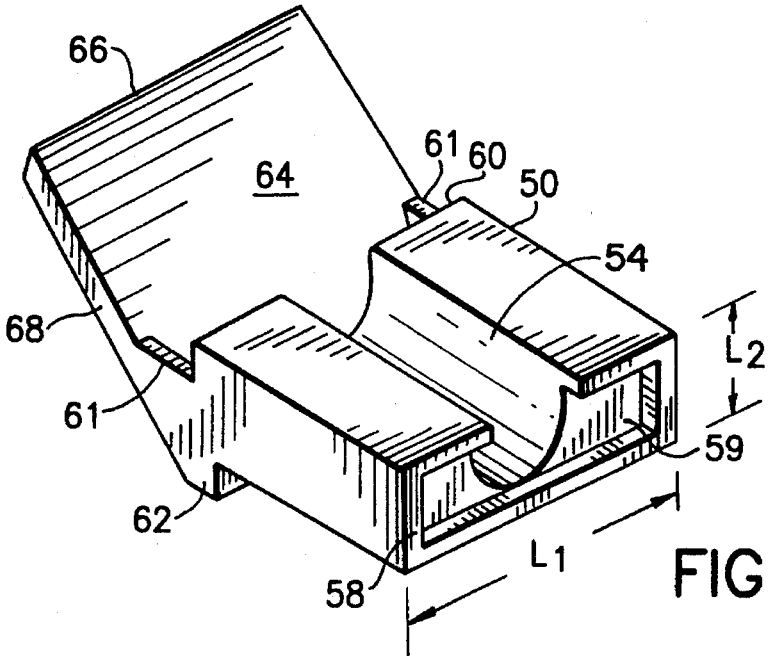
FIG. 7 is a rear perspective view of the valve.
Figure 8:
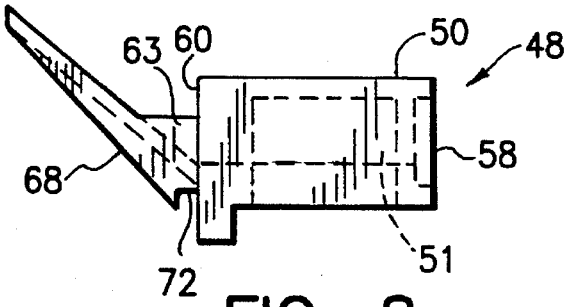
FIG. 8 is a side view of the valve of FIG. 7.

The valve 48 has a base portion 50 with a shape matching the contour of the discharge duct portion 40*a*, shown, for example, in the partial perspective view of FIG. 6. In the preferred embodiment, the discharge duct portion 40*a* and the base portion 50 are rectangular. The rear wall 58 of the base portion 50 includes a rectangular recessed section 59 for receiving a rectangular protruding portion 52 of the discharge duct portion 40*a*. The engagement between the rectangular protruding portion 52 and the rectangular recessed section 59 secures and properly positions the valve 48. The horizontal dimension "L1" and the vertical dimension "L2" of the base portion 42, as shown in FIG. 7, are preferably slightly larger than the corresponding dimensions of the discharge duct portion 40*a* such that the base portion 50 will be held in position through a friction fit. The base portion 50 completely seals the discharge duct portion 40*a* except for a passage 54, which is aligned with the product conveying duct 40 and allows for product passage on actuation, as described further, below. The insert can also be secured within the discharge duct portion 40*a* through matching protrusions and indents on the mating side walls of the two parts, or other attaching means, such as glue. Vertical ribs can also be provided along the side walls of the base 50 to improve the seal between the side walls and the corresponding walls of the discharge duct portion 40*a*.

Figure 9:
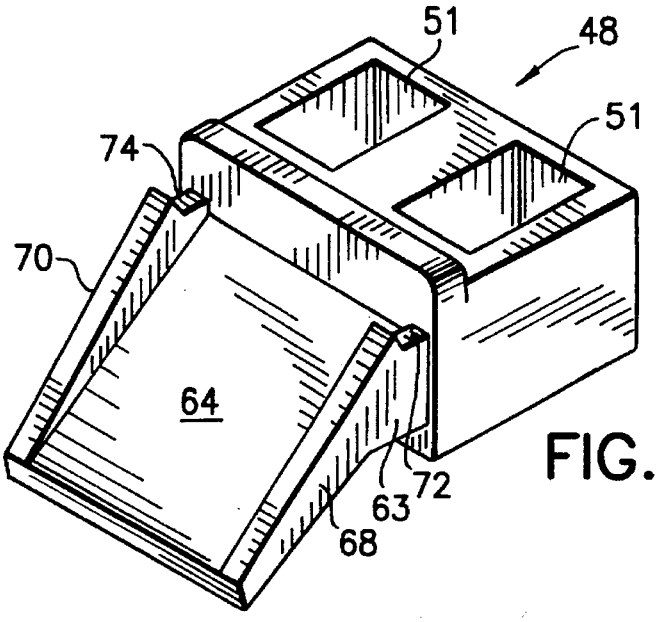
FIG. 9 is a bottom perspective view of the valve of FIG. 7.
Figure 10:
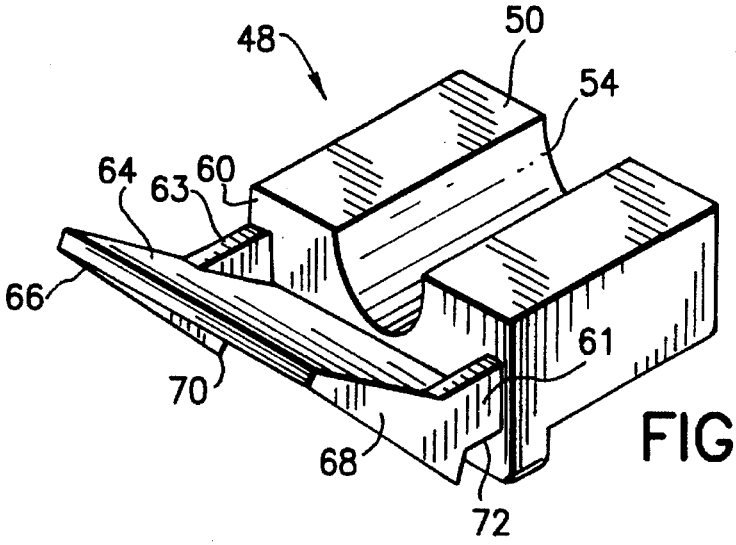
FIG. 10 is a front perspective view of the valve of FIG. 7.

The base portion 50 also has a forward second wall 60 and preferably includes an extension 62 depending downwardly from the bottom of the base portion 50, proximate the second wall 60. This extension 62 acts as a stop which prevents insertion of the valve 48 too far into the discharge duct portion 40*a*. The passage 54 is preferably provided in the top surface of the base portion 50 and extends through the base portion 50 from the first wall 58 to the second wall 60, to allow for the passage of dispensed product. As shown in FIG. 9, the base portion 50 preferably has hollowed sections 51, lessening the bulk material of the base and avoiding shrinkage during molding, as is known in the art.

A resilient leaf spring portion 64 of the valve 48 extends upward at an angle from a portion of the second wall 60 below the passage 54. It preferably extends from the bottom of the second wall 60 of the base 50. Walls 63 are preferably provided to reinforce the connection between the leaf spring 64 and the base portion 50. When positioned within the discharge duct portion 40*a*, the front edge 66 of the leaf spring 64 bears against the inside surface of the top of the discharge duct portion 40*a* with sufficient force to seal this surface, closing the product discharge duct 40, as shown in FIG. 2. The leaf spring portion 64 preferably includes a pair of surfaces 68 and 70 which depend downwardly from the side edges of the leaf spring 64, perpendicular to the top surface of the leaf spring 64. See FIGS. 9–10. These surfaces 68 and 70 are preferably tapered towards the front edge 66 and provide a seal with the side walls of the discharge duct portion 40*a*. This further improves the air tightness of the product conveying duct 40, preventing material left within the duct between uses from drying. These surfaces also prevent product from dispensing over the sides of the leaf spring portion 64, ensuring that the product is dispensed in a controlled, neat manner. In addition, the surfaces 68 and 70 may be connected to the wall 60 through wall portions 72 and 74, respectively. The leaf spring 52 itself is generally not deflected enough for its sides 68 and 70 to clear the side walls of the discharge duct portion 40*a*, also preventing dispensing of product from the sides.

The length of the leaf spring portion 64 and its angle with respect to the base 50 can be varied such that the top of the front edge 66 extends above the top of the base 50, as shown in FIG. 7. This is preferred because when the valve 48 is inserted into the discharge duct portion 40*a*, the leaf spring portion 64 will be forced backward by the top surface of the duct 40*a*. This provides initial stress on the leaf spring portion 64 which increases the force with which the leaf spring portion 64 bears against the top inside surface of the duct 40*a*, improving the seal along this surface. It also increases the restoring force of the leaf spring 64 during product dispensing, improving the closure of the valve when the container is no longer actuated. An angle of between about 40°–50° from horizontal is preferred for dispensing shaving cream, for example. An increased angle will increase the restoring force of the spring while a decreased angle will lessen it.

Extending the leaf spring portion 64 sufficiently above the top of the base 50 also increases the surface area of the leaf spring portion 64 bearing against the top inside surface of the discharge duct portion 40*a*. This also assists in cleanly cutting off the product stream when the actuator is released and improves the seal closing the discharge duct portion 40*a*. When used in a dispensing actuator for shaving cream, it is preferred that the leaf spring portion 40*a* extend about 0.20–0.25 inches above the top of the base 50 at an angle of about 45°. This enables about three-quarters of the length of the leaf spring portion to bear against the top inside surface of the discharge duct portion 40*a* as shown in FIG. 2.

The walls 63, and wall portions 72 and 74, are also provided to reinforce the leaf spring 64, increasing its restoring force. The restoring force of the valve can also be varied by varying the thickness of the leaf spring portion 64 or the use of reinforcement, such as ribbing (not shown), extending from the edge 66 of the leaf spring 64 toward the second wall 60 of the base 50. While use of the valve 48 is preferred, other types of valves can be used, or no valve need be used.

To further improve the seal between the leaf spring portion 64 and the side walls of the lever portion 24, the leaf spring portion 64 can be made wider than the base 50 and grooves can be provided in the side wall to receive the extended portion of the leaf spring.

Returning to FIG. 2, a semi-circular wall 82 depends from the front wall 20 for engaging the mounting cup 45 of the container 12, securing the dispensing actuator cap 10 to the container 12. The wall 82 preferably includes an annular protrusion 84 which snaps over the edge of the mounting cup 45. It is preferable that the cap 10 engage the mounting cup 45 rather than the container bead 16 because the diameter of mounting cups for pressurized containers have closer manufacturing tolerances than the diameter of pressurized containers themselves. The cap 10 can therefore be used on pressurized containers with a broad range of tolerances. Such a cap 10 may also be used with necked-in-containers which do not have an outer container bead to engage. If desired, however, the cap 10 may be designed to engage a protruding container bead by adding a protrusion or an annular recess (not shown) to the bottom inner surface of the base portion 14 which may snap onto an outer container bead, similar to the protrusion 84 at the end of the semi-circular wall 82.

Figure 5:
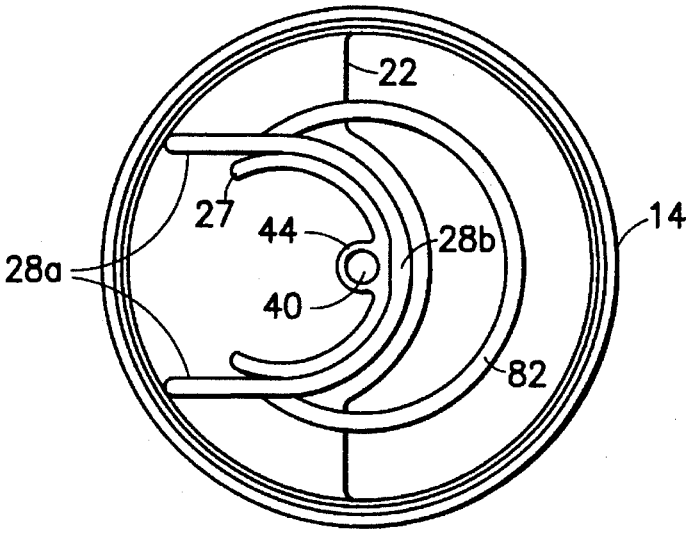
FIG. 5 is a bottom view of the dispensing actuator cap of FIG. 1.

The bottom view of FIG. 5 shows the slot portions 28*a*, 28*b*, the product conveying duct 40, the semicircular wall 82 and the intersection 22 between the forward wall 20 and the rear wall 18.

Figure 11:
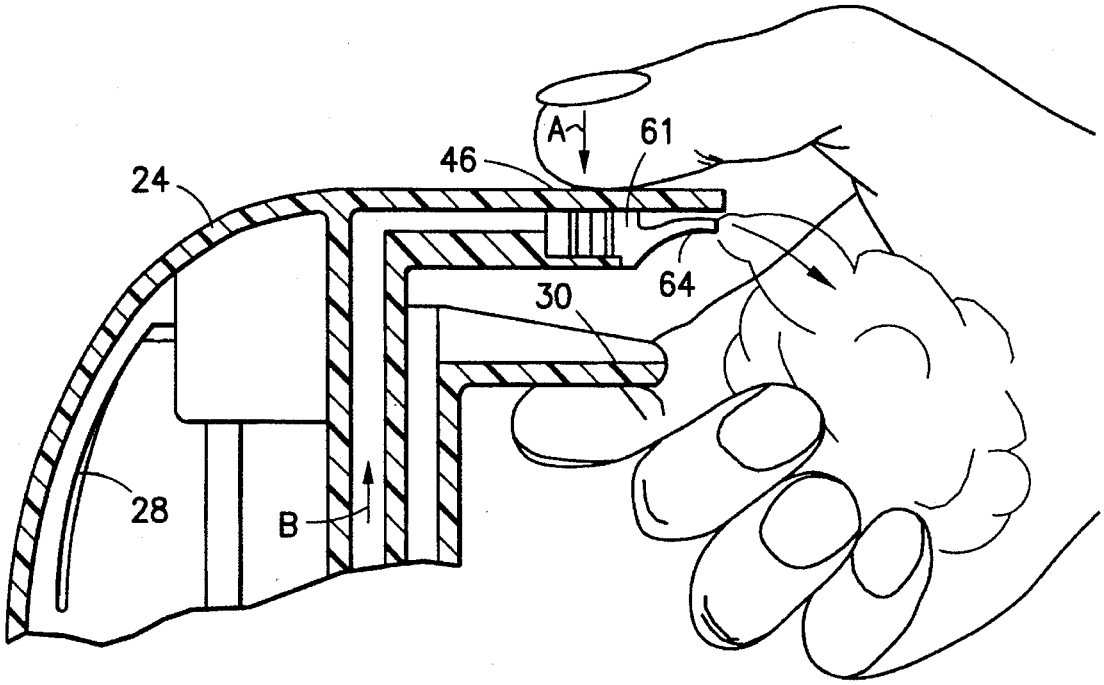
FIG. 11 is a cross-sectional view of the dispensing actuator cap of FIG. 1 in use.

To dispense material with the dispensing actuator cap 10 of the first embodiment of the present invention, one merely places one's thumb on the top surface of the terminus portion 46 of the lever arm 24 and one's index finger against the bottom surface of the supporting arm 30, as shown in FIG. 11. Preferably, the container 12 is resting on a surface, such as a sink or countertop. One could lift the container 12 while engaging the lever arm 24 and supporting arm 30 and dispense while holding the container in mid-air, as well. Only one hand is required to both lift and actuate the container 12.

After properly positioning one's thumb and index finger, one pinches their thumb and index finger towards each other. Arrow "A" indicates the direction of movement of one's thumb and the lever portion 24. This causes sufficient rotation of the lever portion 24 about hinge 29, toward the supporting arm 30, to actuate the valve stem 26. The closer one's thumb is to the end of the lever portion 24, the greater the mechanical advantage and the easier it would be to actuate the valve stem 26.

Dispensing material, indicated by arrow "B", is forced up the product conveying duct 40, through passage 54 in the base 50 of the valve 48. The dispensing material then forces the resilient leaf spring portion 64 of the valve 48 aside, and exits the discharge duct portion 40*a* in the terminus portion 46 of the lever portion 24. When sufficient material has been dispensed, the user releases the pressure pinching the lever portion 24 and supporting arm 30, enabling the lever portion 24 to return to its natural position, closing the valve of the container 12. The valve of the container is normally closed through spring action, as is known in the art. The leaf spring portion 64 of the valve 48 then returns to its natural position bearing against the upper inside surface of the discharge duct portion 40*a*, cutting off the product stream and sealing the product conveying duct 40.

By properly positioning one's thumb and index finger, one's hand assumes an optimum position for receiving material from the discharge duct portion 40*a*, as shown in FIG. 11. This semi-closed position of the hand enables easier actuation than traditional actuation requiring an extended index finger. Since one's thumb is shorter than one's index finger, and is such a strong digit, it can generate greater leverage against the forces of the cap and valve of the container resisting actuation.

Such leverage is further increased through the use of the lever portion 24 rotating about hinge 29. The distance from the hinge 29 to the terminus portion 46 of the lever portion is about twice as long as the distance from the hinge 29 to the valve stem 26. This provides a mechanical advantage of approximately 2, requiring half the force to actuate the container valve than if the actuation portion of the cap was directly above the valve stem 26. Due to the ergonomic and mechanical features of the configuration of the present invention, the mechanical advantage provided for actuating a container is increased many fold over simple finger action directly over the aerosol valve stem 26, making dispensing of product much easier and more controlled.

Since material is discharged through the lever portion 24, the lever portion 24 preferably extends slightly beyond the supporting arm 30, as shown in FIG. 1. It is also preferable that the lever arm 24 extend beyond the supporting arm 30, to accommodate the natural position of the thumb. One's index finger, which bears against the supporting arm 30, naturally extends further from one's hand than the thumb, which engages the forward part 24*a* of the lever portion 24. Both arms are within the plane of the circumference of the base portion 14 of dispensing actuator cap 10, enabling the use of a protective overcap 34, shown in cross-section in FIG. 2. Maintaining the lever portion 24 and supporting arm within the plane of the circumference of the base portion 14 also makes the container/cap combination easier to assemble on an assembly line, package for shipment, and stack on a shelf.

This embodiment of the invention can be used to dispense shaving cream, soap, cosmetics, tanning lotion, medical products and many other products directly into the same hand which actuates the cap, freeing the user's second hand. The invention can also be used to dispense material onto a toothbrush, spoon, or other such device held in the same hand that actuates the cap. While preferred, the supporting arm need not be provided. In such case, a user's thumb would rotate the lever arm 24 to dispense material into the same hand as the thumb, into one's free hand, or onto an object.

THE SECOND EMBODIMENT

Figure 12:
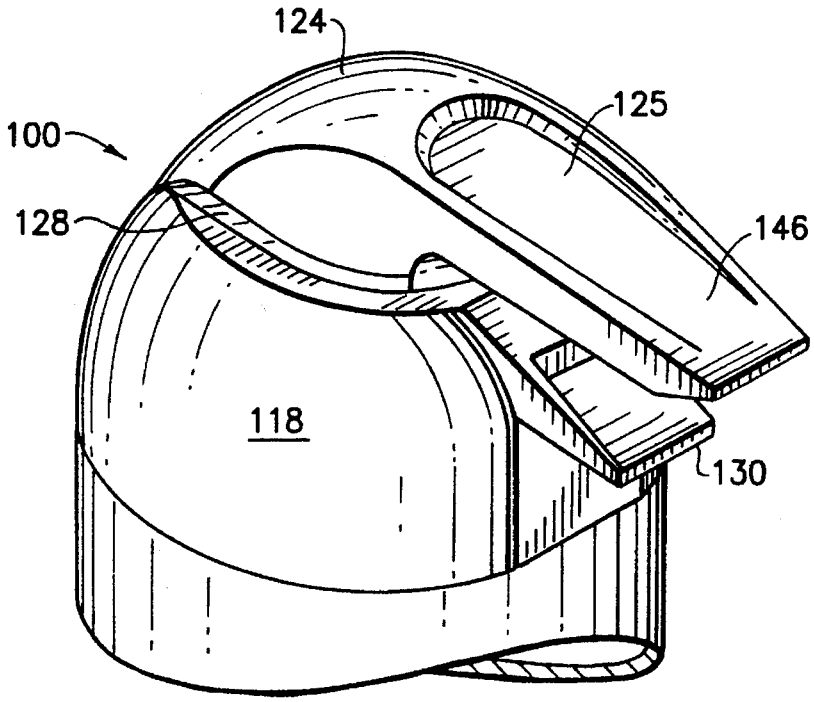
FIG. 12 is a perspective view of a dispensing actuator cap of the second embodiment of the present invention.

A second embodiment of the dispensing actuator of the present invention is shown in FIGS. 12–13. Here, the lever portion 124 and the supporting arm 130 extend beyond the plane of the circumference of the cap 100 and container 12. The cap 100 comprises a generally circular closed outer wall 118 which generally encircles the outer container bead 16 of the container 12. Since the lever portion 124 and supporting arm 130 extend beyond the plane of the circumference of the container 12, there is no need for a recessed front wall portion as in the first embodiment. A semi-circular wall 182 with an annular protrusion 184 preferably depends from the inside surface of the generally circular closed outer wall 118, for engaging the mounting cup 45 of the container 12, as discussed in reference to the first embodiment of the invention. Alternatively, the outer wall 118 can be adapted to engage the container bead 16.

As in the first embodiment, the lever portion 124 is preferably defined by a slot 128, with a parallel portion **128*a* and a connecting portion 128*b* in the outer wall 180. A supporting rib 127 is provided to reinforce the lever portion 124. Because of the low profile of the cap 100, it is preferred that the hinge region 129 extends below the level of the valve stem 26. This increases the displacement of the valve stem 26 on rotation of the lever portion 124 in this embodiment. The distance between the terminus portion 146 of the lever portion 124 and the hinge 129 is almost three times the distance from the valve stem 126 to the hinge 129**, providing even greater leverage and mechanical advantage than the first embodiment.

A recess 125 is optionally provided in the top of the lever portion 140, for more comfortable placement of the thumb on actuation. Such a recess could be provided in any of the embodiments shown herein.

When used to dispense viscous or semi-solid materials such as shaving cream, soap or toothpaste, this embodiment also preferably provides a product shutoff valve, such as the self-closing valve 48, in the discharge duct portion **140*a*, as discussed with reference to the first embodiment. The second embodiment is operated in the same way as the first. While the discharge duct portion 140*a* is shown in the terminus portion 146 of the lever portion 124, it could be recessed from it, dispensing product closer to the cap or in a direction below the lever portion 124. While preferred, the supporting arm 130** need not be provided, as described with respect to the first embodiment.

THE THIRD EMBODIMENT

Figure 14:
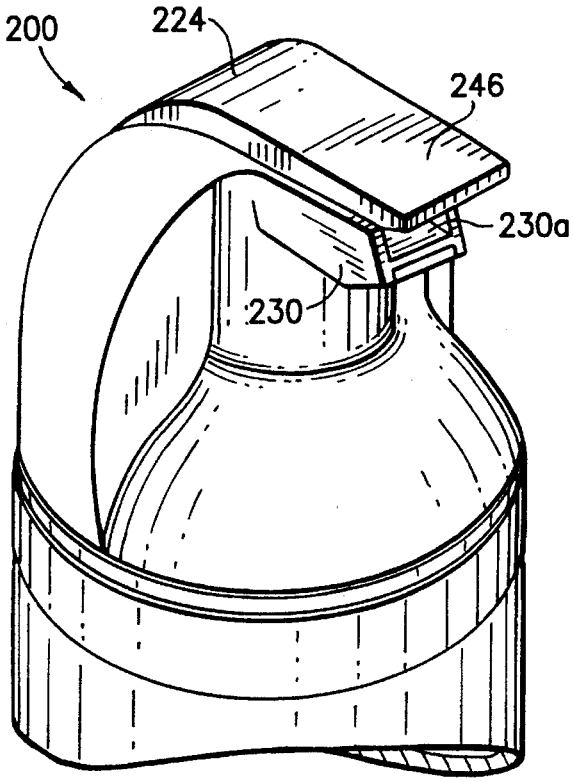
FIG. 14 is a perspective view of a dispensing actuator cap of the third embodiment of the present invention.
Figure 15:
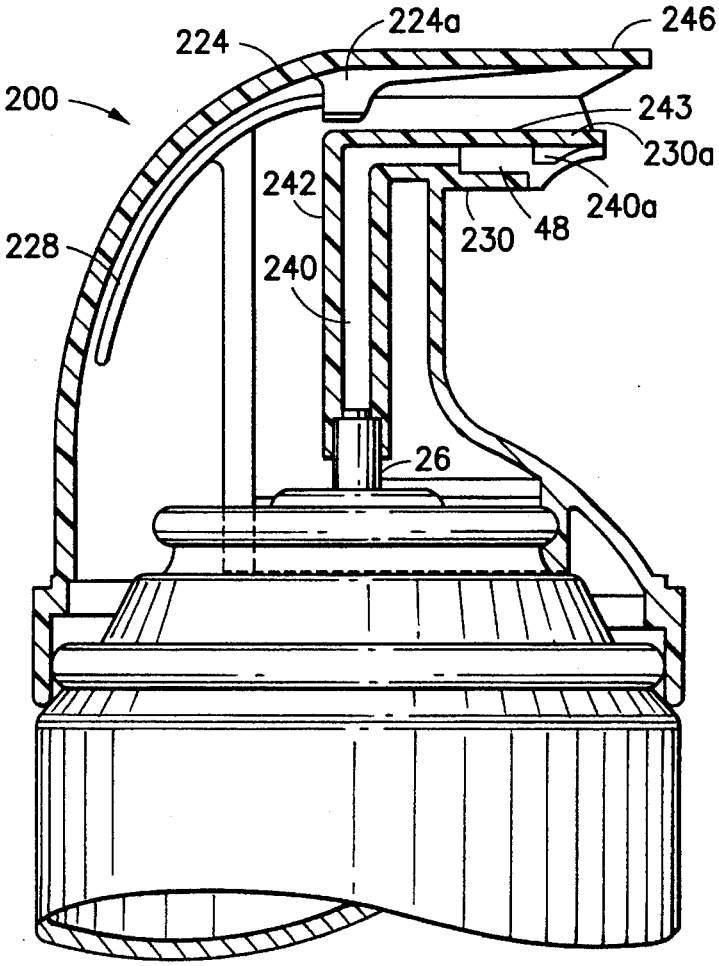
FIG. 15 is a cross-sectional view of the dispensing actuator cap of FIG. 14.

FIGS. 14–15 show an additional embodiment of the present invention which is similar to that of FIGS. 1–5, except that the horizontal tube portion 243 of the product conveying duct 240 is integral with the supporting arm 230. The discharge duct portion **240*a* is preferably in the terminus portion 230*a* of the supporting arm 230. The discharge duct portion 240*a* could also be recessed from the terminus portion 230*a***, for dispensing of product closer to the cap or in a direction below the supporting arm.

In the preferred way of implementing this embodiment, the lever arm 224, defined by the slot 228, includes a downwardly depending portion **224*a* which is preferably aligned with the vertical axis of the valve stem 26 and the vertical tube portion 242. See FIG. 15. The portion 224*a* is positioned with a small clearance with the top of the vertical tube portion 242, which engages the valve stem 26. Other illustrated portions of the cap 200** are the same as those described with respect to earlier embodiments.

After properly positioning one's hand as described with respect to the first embodiment, downward movement of one's thumb displaces the lever portion 224, causing the downwardly depending portion **224*a* to engage and then displace the vertical tube portion 242 sufficiently to actuate the valve of the container 12**. The valve of the container in this embodiment is preferably actuated by vertical displacement.

On actuation, material exits the container, into the vertical tube portion 240, the horizontal tube portion 243, and out the supporting arm 230, into one's hand. While the vertical tube portion 242 can move downward a sufficient distance to actuate the valve of the container, the rigidity of the forward wall portion 220 preferably maintains the supporting arm essentially stationary.

Because the product pathway is shorter than in the first and second embodiments, product can be dispensed faster, with less foaming and drip. Also, less material may be left in the product conveying duct 240 between uses than in the product conveying duct 40 in the embodiments of FIGS. 1–5. When dispensing viscous or semi-solid materials, the discharge duct portion 240 preferably includes the self-closing valve, valve 48, which has been described in relation to FIGS. 6–10. The second embodiment could be modified in a similar fashion to dispense from the supporting arm, as well.

THE FOURTH EMBODIMENT

Since the "pinching" actuation technique and lever arm configuration provide mechanical advantages easing operation, they may be advantageously employed in more traditional dispensing configurations, such as where the product is dispensed in a direction away from the person actuating the container. The dual arm configuration can be used to hold and aim the dispensing actuator and container during use, as well as to actuate the container. This configuration would be useful for air fresheners and household treatments such as window cleaners, disinfectants, insecticides, and the like, in addition to shaving cream, toothpaste, soap or other such materials. The pinch actuation technique could be advantageously applied by arranging the arms side by side, as well.

Figure 16:
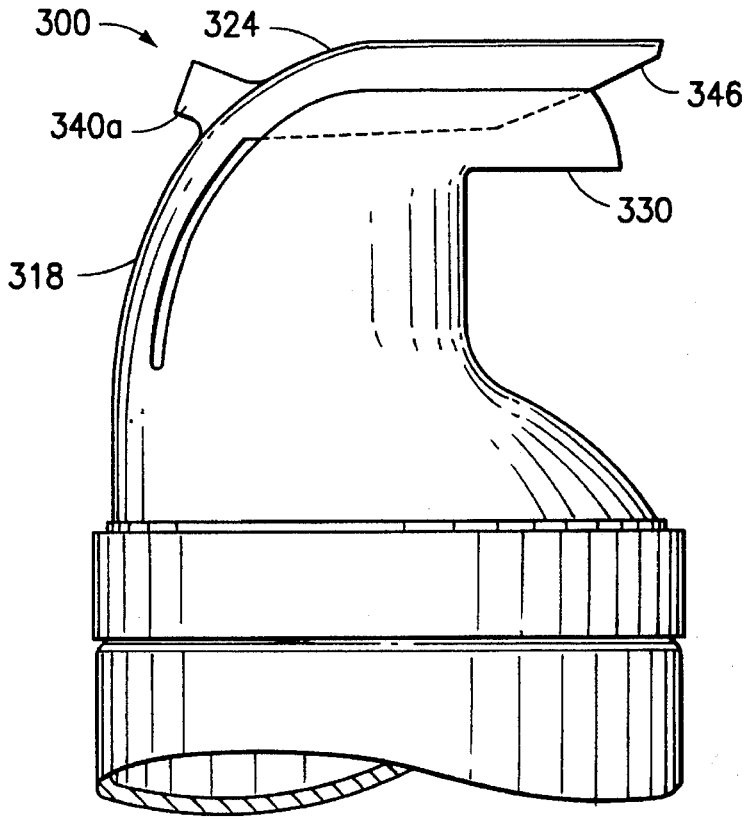
FIG. 16 is a side view of the fourth embodiment of the dispensing actuator cap of the present invention.
Figure 17:
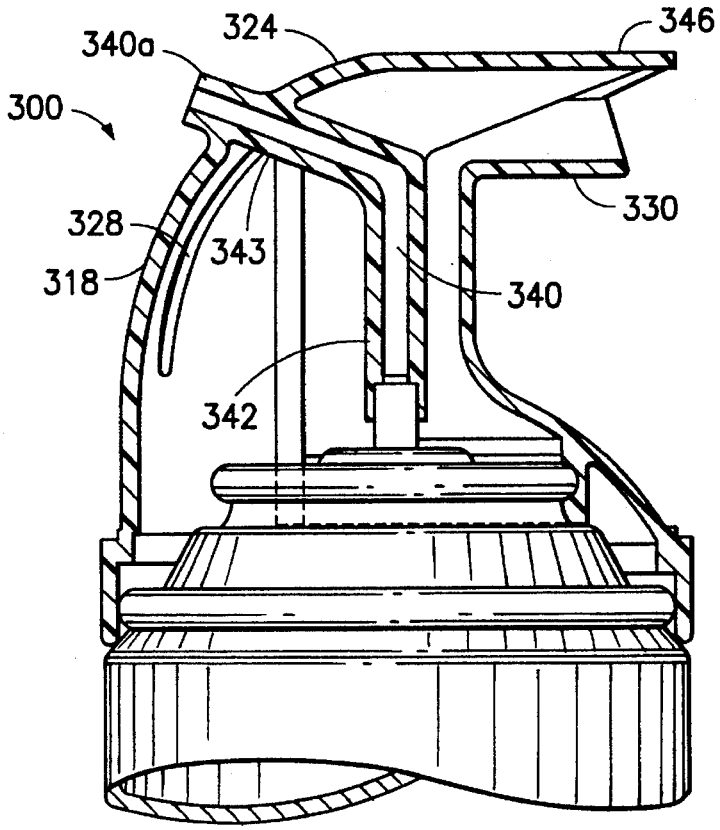
FIG. 17 is a cross-sectional view of the dispensing actuator cap of FIG. 16.
Figure 18:
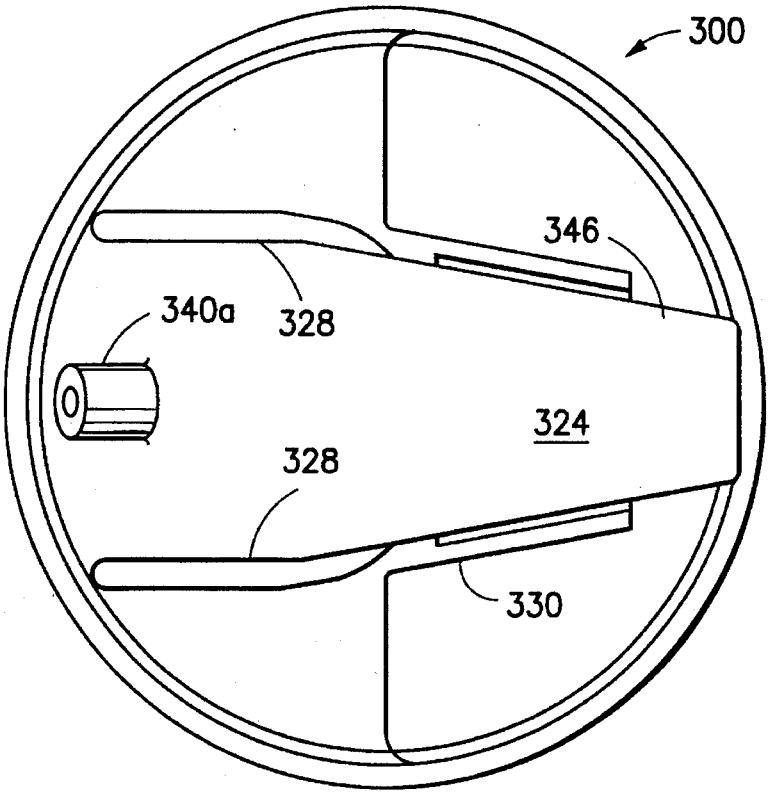
FIG. 18 is a top view of the dispensing actuator cap of FIG. 17.

FIGS. 16–18 are side, cross-section, and top views, respectively, of such a cap 300, wherein the discharge duct portion **340*a* of the product discharge passage 340 is not associated with either the terminus portion 346 of the lever portion 324 or with the supporting arm 330. As shown in FIG. 17, the vertical tube portion 342 merges with a tube portion 343 which extends through a portion of the cap, such as through the portion of the rear wall 318 within the slot portion 328 defining the lever arm 324. While shown angled, this tube portion 343 can also extend essentially horizontally or essentially vertically. The discharge duct portion 340*a*** preferably extends just slightly beyond the rear wall 318, to allow for an overcap (not shown). The discharge duct portion 340*a* could extend out farther if an overcap is not needed.

This cap 300 is operated in the same way as the cap 10 of FIGS. 1–5, except that the cap and container must be pointed in the desired direction or location for dispensing material. Displacement of the lever portion 324 causes a displacement of the angled tube portion 343 and vertical tube portion 342, causing actuation of the valve of the container 12. The discharge duct portion 340*a* can be positioned for discharge anywhere along the lever portion 324. A dispensing actuator made in accordance with this embodiment of the invention could be advantageously used to dispense material into one's free hand, onto an object such as a toothbrush, onto a surface or into the air, for example.

If used to dispense air fresheners or other materials which would not leave a solid residue in the product conveying duct 340, a product shutoff valve would not be needed. An atomizer or swirl chamber could be used to enhance the spray characteristics of the dispensing material, if desired, as is known in the art. If used to dispense more viscous materials, inclusion of the self-closing valve 48 would be preferred, as discussed above. Other illustrated portions of the cap are the same as those previously described with respect to earlier embodiments. While described with respect to a configuration similar to that of FIGS. 1–5, the embodiment of FIGS. 12–13 could similarly be adapted for rear dispensing.

Figure 20:
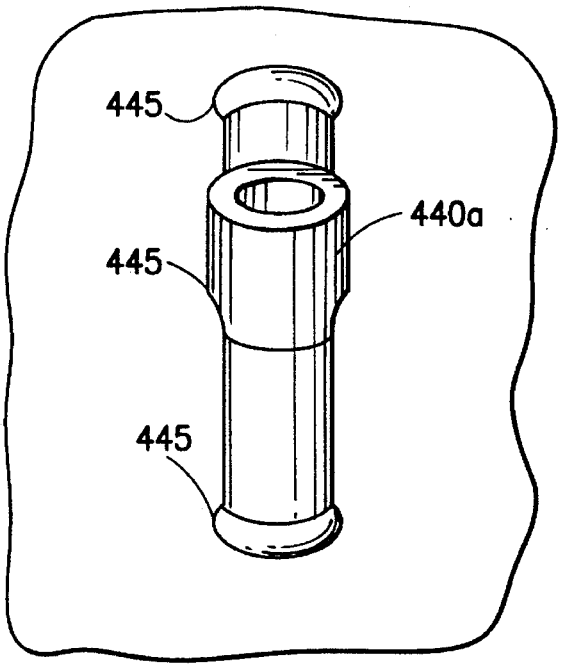
FIG. 20 is a rear view of a portion of the dispensing actuator cap of FIG. 22.
Figure 19:
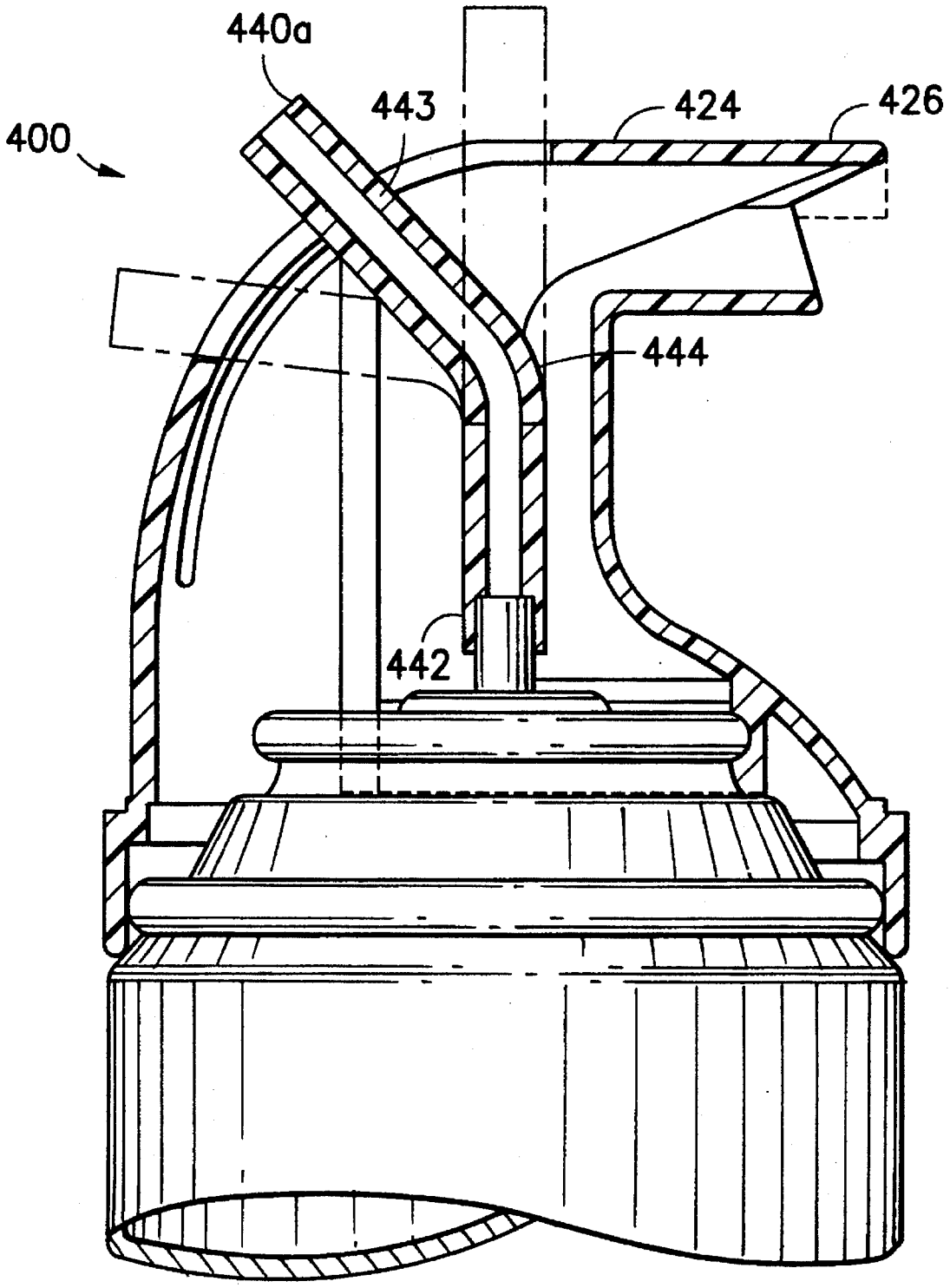
FIG. 19 is a cross-sectional view of a modification of the fourth embodiment of the present invention.

A further modification to the fourth embodiment enables variable positioning of the discharge duct portion 440*a* by a consumer, as shown in FIG. 19. The vertical tube portion 442 merges with the tube portion 443 through a flexible region 444. The rear part of the lever portion 424 includes a series of detents 445 through which the angled tube portion 443 can be advanced to adjust the position of the discharge duct portion 440*a*. FIG. 20 is a partial rear view of the dispensing cap 400, showing the location of the detents 445. Three pairs of detents 445 are located such that the discharge duct portion 440*a* can be located about 10° below the horizontal, 45° from horizontal and in a vertical position. Additional positions can be provided, as well. The detents 445 should securely engage the angled tube portion 443 to ensure a precise discharge position, and enable rotation of the lever portion 424 on actuation to sufficiently displace the tube portion 443 and vertical tube portion 442 to actuate the container valve. The flexible tube portion can be molded from polypropylene.

Figure 21:
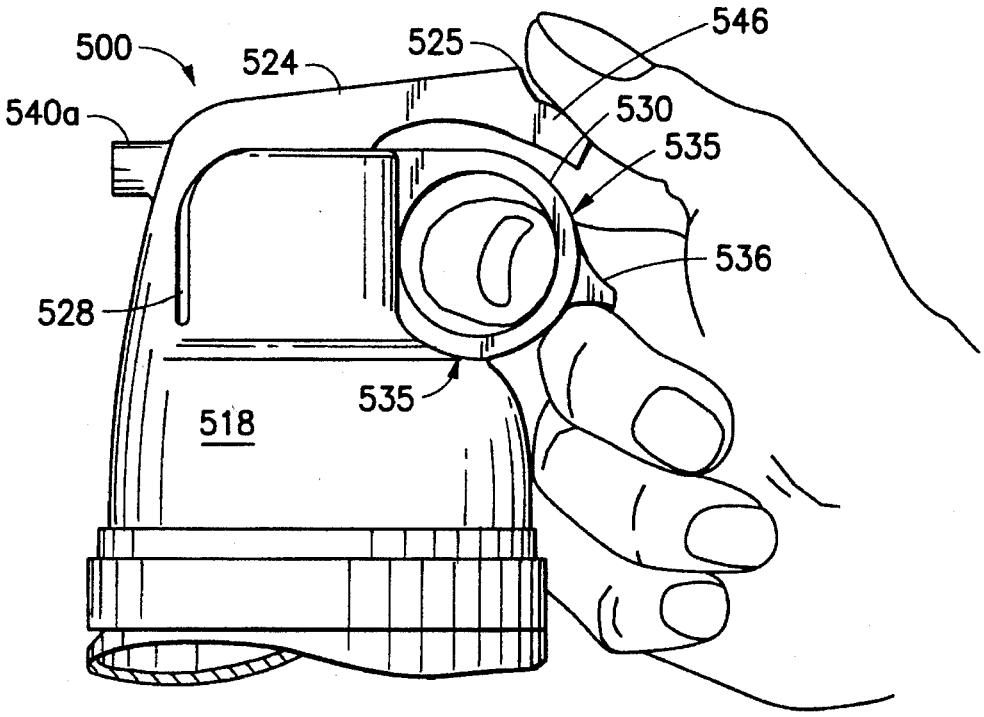
FIG. 21 is a side view of another modification of the dispensing actuator cap of the fourth embodiment of the present invention.
Figure 22:
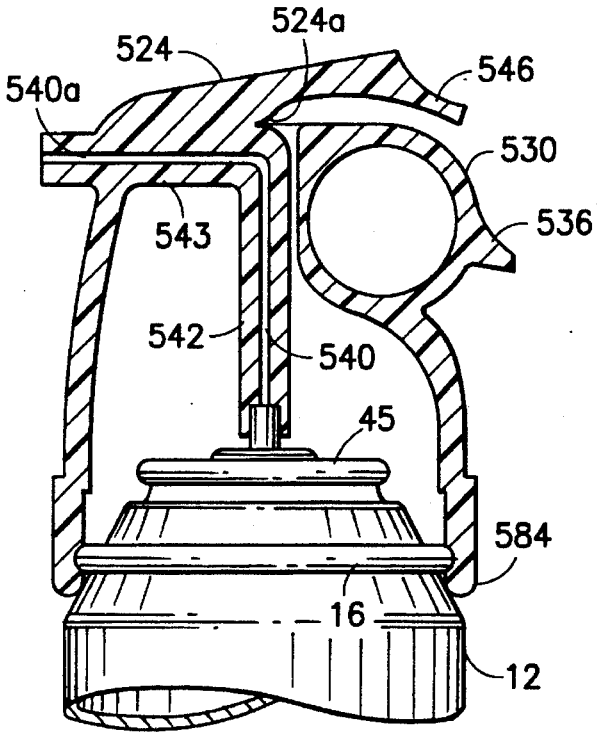
FIG. 22 is a cross-sectional view of the embodiment of FIG. 21.

FIGS. 21–22 illustrate another modification to the fourth embodiment, wherein the supporting arm 530 is curved downward to provide a region that the index finger can wrap around, enabling a more secure grip on the cap 500 during dispensing, as well as improving the user's ability to aim the cap. Preferably, the supporting arm 530 forms an upper part of a ring, generally designated as 535. The ring 535 is preferred because it can also serve as a convenient means for carrying the container 512 with one's finger slipped through the ring 535. The rear of the ring 535 preferably includes an additional arm 536 which provides support for the user's middle finger. This further secures the user's grip and aim while dispensing. Such an additional arm can also be provided extending from the cap itself, in this or any of the embodiments shown.

As shown in the cross-sectional view of FIG. 22, the product conveying duct 540 can comprise a vertical tube portion 542 and a horizontal tube portion 543. A ridge 525 can be provided on the lever portion 524 for a user's thumb to bear against, if desired. The cap is attached to the container 12 through an annular protrusion 584 which snaps over the edge of the container bead 16. This embodiment can be adopted to engage the mounting cup 45, as well.

To operate the cap 500, one's thumb preferably engages the terminus portion 546 of the lever portion 524, while one's index finger of the same hand slips through the ring portion 535, and is supported by the supporting arm 530. One's middle finger can be supported by the additional arm 536. Pressure exerted by one's thumb on the lever portion 524 rotates the lever portion 546 toward the supporting arm 530, displacing the vertical tube portion 542 downward, actuating the valve of the container 518. The valve is preferably actuated through vertical displacement, but this embodiment can be configured for tilt actuation as well.

Easy to actuate and direct while held in the hand, the embodiment of FIGS. 21–22 is useful for dispensing all types of materials, including air fresheners, window cleaners and other household cleaning goods, or insecticides. It can be particularly useful where prolonged steady usage is required, such as in applying spray paint, because it is so easy to hold. This embodiment could also be particularly useful in actuating pump dispensers.

The dispensing actuator cap of all the embodiments shown and the self-closing valve 48 are preferably made of a commercially available plastic, such as an olefin. The plastic should be resilient, suitable for molding and chemically resistant to the material to be dispensed from the container. Polypropylene and polyethylene are preferred because they are inexpensive, enable high cycle times during molding, and are chemically resistant to commonly dispensed products. The plastic can be filled, such as with talc or glass, for added strength and resilience. Engineering resins, such as certain polyamides, polyacetyls, polycarbonates, acrylonitrilebutadienestyrene and nylon meeting the criteria of resilience, ease of molding and chemical resistance can also be used, particularly for the valve 48.

A preferred polypropylene for the dispensing actuator cap and valve member is Pro-fax (TM) PD-701N, a high flow nucleated homopolymer resin from HIMONT Incorporated.

Typical property values appear below:

| Properties | Pro-fax PD-701N | ASTM Method |
|---|---|---|
| Melt Flow dg/min. | 35 | D1238 |
| Density, g/cm$^3$ | 0.9 | D792 |
| Flexural Modulus, psi (MPa) | 220,000 (1500) | D790 |
| Tensile Strength at yield, psi (MPa) | 5,100 (35) | D638 |
| Elongation @ Yield, % | 10 | D638 |
| Deflection Temperature, °F. (°C.) @ psi (455 kPa) | 250 (121) | D648 |

The material chosen for the valve 48 must have sufficient resilience for the leaf spring portion 64 of the valve member to maintain its normally closed position sealing the product passage 40 and to return to its normally closed position when material is not being dispensed. The cap and valve member need not be of the same material.

The dispensing actuator cap of the present invention is preferably molded in one piece by injection molding or other conventional molding processes, as is known in the art. The valve member is preferably molded separately. Separate molding enables the valve member to be formed such that the leaf spring portion extends above the top of the base, as described above, enabling its insertion under stress, increasing the force and surface area with which it bears against the inside surface of the discharge duct portion.

The dispensing actuator of the present invention has been described in use with a pressurized container. Any of the known barrier package systems, such as those using a piston or those referred to as a bag-in-can, may also be used. See, for example, San Giovanni, Michael L., "Alternative Systems Push for Market Share," Spray Technology & Marketing, August 1992, pp. 37–44, for a discussion of such systems. The dispenser of the present invention can also be used with manually pressurized containers, including pump type dispensing systems. It can be used with wall dispensers or other types of dispensing systems, as well.

The dispensing actuator of the present invention, with its discharge duct in either the lever arm or the supporting arm, is a unique and preferred embodiment of this invention which allows for the dispensing of a wide variety of materials towards the user. This in turn allows product to be dispensed directly and conveniently into one's hand or articles held in one's hand, such as toothbrushes, spoons, brushes or the like, in single handed operation. The dispensing actuator of the present invention is also useful for dispensing a wide variety of materials through a discharge duct located in some other portion of the cap for dispensing of material in a direction away from the user. In both cases the mechanical leverage provided by the configuration of the cap increases the force transmitted to the valve of the container. This, coupled with the natural strength of the thumb, enables easier and more controlled dispensing of material than is possible with dispensers actuated by finger pressure directly above the valve of the container.

I claim:

1. A dispensing actuator for dispensing material stored within an aerosol container having a valve-bearing mounting cup with a pedestal portion and further having a valve stem extending through an opening in the pedestal portion of the mounting cup, the dispensing actuator comprising:

a recess to receive in sealing engagement of the valve stem extending through the pedestal portion of the mounting cup;

a duct extending from the valve stem receiving recess to a discharge outlet, which duct provides a passage allowing product to exit the dispensing actuator;

two arms extending transverse the valve stem receiving recess in proximate relation and in an outer and inner spatial relation relative to the valve-bearing mounting cup when the actuator is disposed on an aerosol container, the outer arm being movable towards the inner arm and the outer arm being operably connected with the valve-stem receiving recess such that the movement of the outer arm towards the inner arm opens the valve in the valve-bearing mounting cup to dispense product from the aerosol container.

2. The dispensing actuator of claim 1 wherein the moveable arm can rotate about an axis when sufficient pressure is exerted upon it, providing a mechanical advantage.

3. The dispensing actuator of claim 1 wherein the moveable arm has a top surface for engagement by a user's thumb and the other arm has a bottom surface for engagement by a user's index finger of the same hand as the thumb.

4. The dispensing actuator of claim 3 wherein the discharge duct is in the moveable arm.

5. The dispensing actuator of claim 3 wherein the discharge duct portion extends from a portion of the cap for dispensing of material in a direction away from the user.

6. The dispensing actuator of claim 1 wherein the discharge duct has a product shutoff valve.

7. The dispensing actuator of claim 6 wherein the product shutoff valve comprises a leaf spring.

8. The dispensing actuator of claim 1 wherein the container has a top with a circumference and the first and second arms are within the plane of the circumference of the container.

* * * * *